US010842291B2

(12) United States Patent
Theosabrata

(10) Patent No.: US 10,842,291 B2
(45) Date of Patent: Nov. 24, 2020

(54) MATTRESS CONSTRUCTION WITH SELF INFLATED AIR SPRING

(71) Applicant: Yos Soetanto Theosabrata, Jakarta (ID)

(72) Inventor: Yos Soetanto Theosabrata, Jakarta (ID)

( * ) Notice: Subject to any disclaimer, the term of this patent is extended or adjusted under 35 U.S.C. 154(b) by 213 days.

(21) Appl. No.: 15/872,094

(22) Filed: Jan. 16, 2018

(65) Prior Publication Data

US 2019/0216226 A1 Jul. 18, 2019

(51) Int. Cl.

| | |
|---|---|
| ***A47C 27/18*** | (2006.01) |
| ***A47C 27/06*** | (2006.01) |
| ***A47C 27/08*** | (2006.01) |
| ***A47C 27/14*** | (2006.01) |
| ***A47C 27/05*** | (2006.01) |
| ***A47C 27/20*** | (2006.01) |
| ***A47C 27/15*** | (2006.01) |

(52) U.S. Cl.

CPC ..... *A47C 27/18* (2013.01); *A47C 27/056* (2013.01); *A47C 27/061* (2013.01); *A47C 27/082* (2013.01); *A47C 27/084* (2013.01); *A47C 27/148* (2013.01); *A47C 27/15* (2013.01); *A47C 27/20* (2013.01)

(58) Field of Classification Search

CPC ..... A47C 27/15; A47C 27/20; A47C 27/084; A47C 27/056; A47C 27/148; A47C 27/082; A47C 27/061; A47C 19/025; A47C 7/142; A47C 7/025; A47C 27/10; Y10S 5/936; A61G 7/05707; A61G 7/1027; A61G 7/10; B60N 2/914; B60N 2/7094; B60N 2/72

See application file for complete search history.

(56) References Cited

U.S. PATENT DOCUMENTS

| | | | | |
|---|---|---|---|---|
| 5,369,828 | A * | 12/1994 | Graebe | A47C 4/54 5/654 |
| 5,584,084 | A | 12/1996 | Klearman et al. | |
| 5,836,027 | A | 11/1998 | Leventhal et al. | |
| 5,907,878 | A | 6/1999 | Thomas et al. | |
| 6,212,720 | B1 | 4/2001 | Antinori et al. | |
| 6,415,467 | B1 * | 7/2002 | Bretvin | A47C 4/54 5/710 |

(Continued)

FOREIGN PATENT DOCUMENTS

| | | |
|---|---|---|
| FR | 2584284 A1 | 1/1987 |
| JP | S5683267 | 4/1981 |

OTHER PUBLICATIONS

International Search Report (ISR) and Written Opinion (WO) from PCT/IB2019/000041; European Patent Office; dated Apr. 1, 2019.

*Primary Examiner* — Robert G Santos
*Assistant Examiner* — Alison N Labarge
(74) *Attorney, Agent, or Firm* — Keusey & Associates, P.C.

(57) ABSTRACT

A multi-layer air mattress having an upper section with one or more layers of comfort material and a lower section having one or more layers of support material. A middle layer is arranged between the upper and lower sections and includes apertures for retaining air springs. The air spring has two cups that are sealed to a form plate to create a welded joint that encapsulates a sealed internal cavity. An invertible nipple is pressed into the internal cavity to reduce the cavity volume and self inflate the air spring.

18 Claims, 3 Drawing Sheets

(56) References Cited

U.S. PATENT DOCUMENTS

| | | | | |
|---|---|---|---|---|
| 6,510,573 | B1 * | 1/2003 | Grabe | A47G 9/1027 5/490 |
| 6,560,803 | B2 | 5/2003 | Zur | |
| 6,598,251 | B2 | 7/2003 | Habboub et al. | |
| 6,701,556 | B2 | 3/2004 | Romano et al. | |
| 6,745,420 | B2 | 6/2004 | Giori et al. | |
| 7,386,903 | B2 | 6/2008 | Hochschild | |
| 8,863,336 | B2 * | 10/2014 | Theosabrata | A47C 19/025 5/652.1 |
| 2005/0177952 | A1 | 8/2005 | Wilkinson | |
| 2006/0085919 | A1 * | 4/2006 | Kramer | A47C 27/082 5/713 |
| 2018/0042396 | A1 * | 2/2018 | Nakamura | A47C 27/10 |
| 2018/0098639 | A1 * | 4/2018 | Dahl | A47C 27/08 |

* cited by examiner

MATTRESS CONSTRUCTION WITH SELF INFLATED AIR SPRING

BACKGROUND OF THE INVENTION

1. Field of the Invention

The invention relates to a multi-layer mattress construction with self inflated air spring.

2. The Prior Art

Mattresses typically found in permanent locations in bedrooms and hotels employ coil springs disposed below one or more layers of comfort material. Over periods of extended use the springs eventually fatigue and deform. In addition, the construction of coil spring mattresses is complicated which drives up the cost. Finally, coil spring mattresses are heavy which make it difficult to move them for cleaning or re-positioning.

To address some of these drawbacks, companies have employed newer comfort materials to provide foam mattresses or air mattresses. For example, U.S. Pat. No. 5,836,027 has a foam mattress with a matrix arrangement of interior cavities. An air spring is located within each of the cavities. Transfer tubes are connected between selected air springs to distribute air between the air springs in response to changing pressures on the mattress.

U.S. Pat. No. 5,907,878 omits the foam matrix and provides a lower matrix of air springs with gaps therebetween to receive air springs from an upper matrix. Tubes connect adjacent air springs to distribute air between them in response to changing pressure on the mattress.

U.S. Published Patent Application 2005/0177952 has fluid cells containing a spring bias. Each of the fluid cells includes a multiple port air distribution system to control the intake and outflow of pressurized air from a compressor. The ports are coupled to a matrix switch enabling the user to selectively adjust the port settings to customize the pressure at various locations within the mattress.

Coupling air springs together with transfer tubes is an involved process that increases the complexity and cost of the resulting air mattress. The addition of a ports and a compressor increases the weight of the mattress system. Most significantly, the tubes and their various connections provide a large number of points where the pressurized manifold and the coupled air springs can leak resulting in the loss of the entire mattress.

It would be desirable to provide an air mattress that is constructed in a simple and efficient manner. In addition, it would be desirable to provide an advanced air spring design that is self inflated. Air springs that are self inflatable to proper pressure will eliminate the need for transfer tubes, manifolds and compressors.

SUMMARY OF THE INVENTION

It is therefore an object of the invention to provide an air mattress of simple and inexpensive construction while maintaining comfort and durability.

It is a further object of the invention to provide an air spring design that allows them to be self inflated.

It is another object to provide an air mattress with air springs that do not require connecting tubes.

It is yet a further object of the invention to manufacture an air spring that does not require inflation or a compressor at any time.

These and other related objects are achieved by a multi-layer air mattress having three sections. The layer closest to the user is the upper section having one or more layers of comfort material. The middle layer has dozens of air spring retaining apertures arranged in a matrix. The layer farthest from the user is the lower section having one or more layers of support material. An air spring is located in each of the air spring supporting apertures. The air springs have a sealed internal cavity in communication with an invertible nipple that can be pressed into the internal cavity to reduce the cavity volume and self inflate the air spring.

The nipple has (i) an outwardly extending position in which the air spring is at an initial pressure and (ii) an inwardly extending position in which the air spring is at an elevated pressure above the initial pressure. The air spring is formed from two molded cups. The cup includes a bottom, a cylindrical body and an annular lip. The annular lips of two molded cups are hermetically sealed to each other around their entire periphery to form the sealed internal cavity. Alternatively, the annular lips of two molded cups are hermetically sealed to opposing sides of a form plate around their entire periphery to create the sealed internal cavity.

The nipple is located at the bottom of the molded cup, preferably centrally located in the middle of the cup bottom. The molded cup is made from a material selected from the group consisting of polyvinyl chloride, polyurethane and synthetic rubber. The annular lip, cylindrical body, bottom and nipple are formed at the same time, as one unitary part, to form the molded cup. The cylindrical side includes alternating annular ribs and annular grooves that form bellows-like folds to compress and expand under changing pressure. In the inwardly extending position the nipple is disposed concentrically within the annular ribs and grooves. The nipple includes a flexible tubular wall that folds in on itself when the nipple is transitioning between its outwardly extending position and its inwardly extending position. The nipple includes a bulbous tip that is domed away from said form plate when the nipple is in the outwardly extending position and is domed toward said form plate when the nipple is in the inwardly extended position.

The form plate is a calendared form plate with an opening formed therein. The two annular lips are welded to opposing sides of the form plate to create a welded joint. Under changing pressure conditions air flows from one welded cup to the other welded cup through the opening while the calendared form plate maintains the annular lips at their circular configuration to resist expansion and collapse of the cylindrical bodies. The calendared form plate is made from the same material as said molded cup has a thickness of 0.2-0.4 mm thick, and is trimmed to the circular dimensions of the welded annular lips.

The air spring retaining apertures have a diameter approximately the same as the trimmed, calendared form plate and the welded annular lips. The retaining aperture diameter is greater than the diameter of said annular ribs and grooves so that the annular ribs and grooves can fold and unfold like a bellows without interference or contact with the middle layer.

Each air spring includes two nipples. In one embodiment both nipples are in the outwardly extending position upon creation of the welded joint to set the initial pressure. In this configuration both nipples are depressed into the inwardly extending position to establish the elevated pressure. In an alternate embodiment, one nipple is in the outwardly extending position and one nipple is in the inwardly extending position upon creation of the welded joint to set the initial pressure. In this configuration the one outwardly extending nipple is depressed into the inwardly extending position to establish the elevated pressure. Both embodiments may be generically described as one nipple in the outwardly extending position and the other nipple selectively set in the inwardly extending position or the outwardly extending position upon creation of the welded joint to set the initial pressure.

The middle layer has a height equal to the height of two molded cups when both nipples are depressed. Depressing both nipples results in an elevated pressure that is between 0.02-0.06 psi greater than the initial pressure. The middle layer is made from polyurethane foam or memory foam. The upper section includes a medium density foam layer made from polyurethane foam or memory foam and having a density between 20-35 kgs/m3. The upper section also includes a low density foam layer made from polyurethane foam or memory foam and having a density between 10-20 kgs/m3. The lower section includes a high density foam layer made from a material selected from the group consisting of polyurethane foam and memory foam and having a density between 35-50 kgs/m3.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF THE PREFERRED EMBODIMENTS

Figure 1:
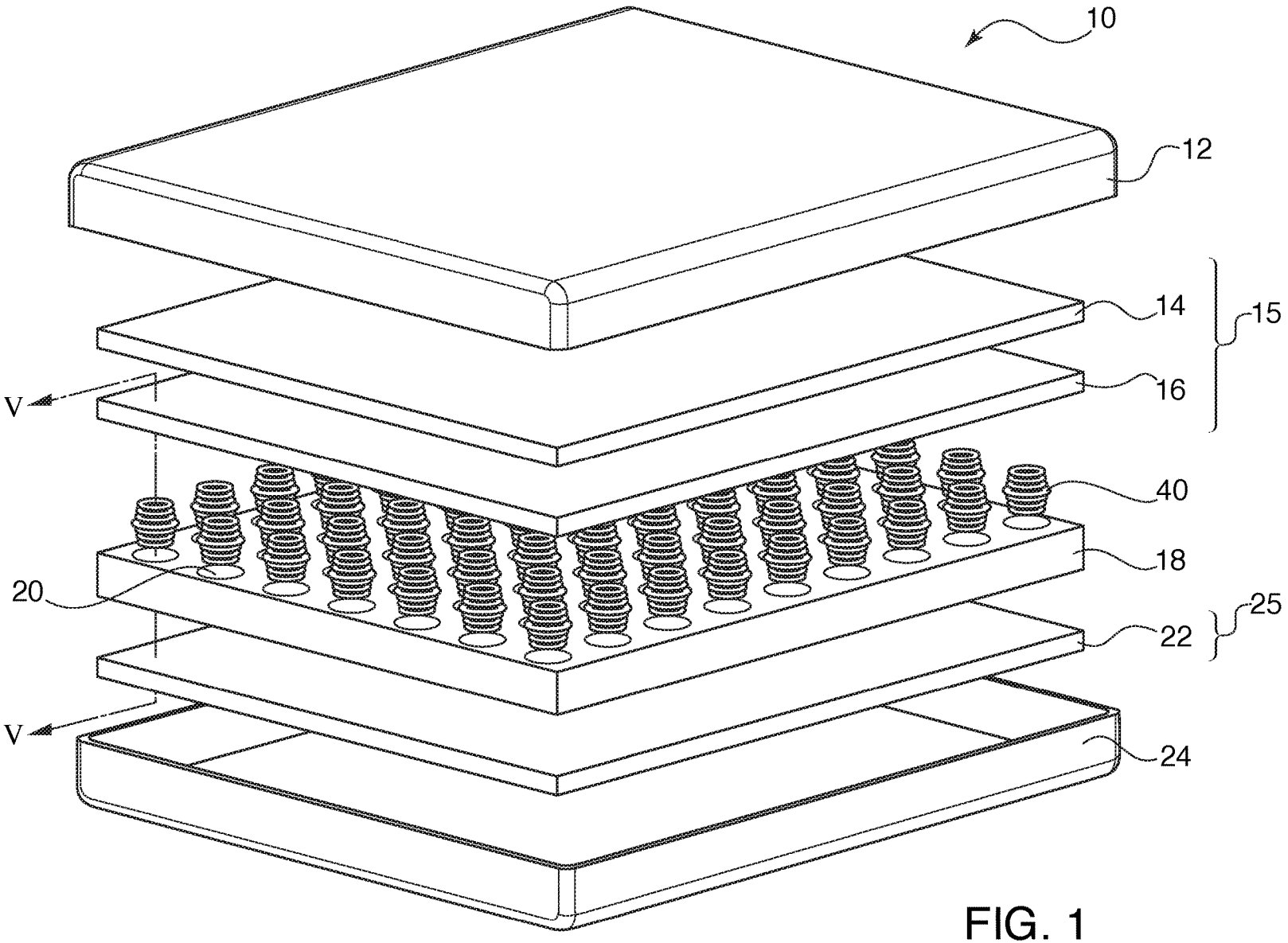
FIG. 1 is an exploded view of an air mattress according to the invention showing the multiple layers.

Referring now in detail to the drawings, and in particular FIG. 1, there is shown an exploded view of an air mattress 10 according to the invention. Air mattress 10 has multiple layers, which can be summarized as a middle layer 18 containing air springs 40 sandwiched between an upper section 15 and a lower section 25. The upper section 15, middle layer 18 and lower section 25 are contained within an outer cover, depicted as top cover 12 and bottom cover 24.

Upper section 15 includes one or more layers of comfort material. As will be understood by those familiar with mattress construction, the upper section is closest to the user's body and provides a degree of support along with a smooth and pliable texture capable of giving under the various pressure points of the user's body. Comfort material means bedding layers that are primarily pliable and secondarily supportive. In the invention, this is achieved by providing a medium density foam layer 14 set atop a low density foam layer 16. Layer 14 is made of polyurethane foam or memory foam having a density between 20-35 kilograms per cubic meter (kgs/m3). Layer 16 is made of polyurethane foam or memory foam having a density between 10-20 kgs/m3. Memory foam is also known as viscoelastic polyurethane foam or low-resilience polyurethane foam (LRPu). Layers 14 and 16 are planar panels of foam, extending the full length and width of the mattress and having a thickness of 1 inch or greater, preferably about 2 inches thick.

Middle layer 18 is made from polyurethane or memory foam and includes air spring retaining apertures 20. Apertures 20 are arranged in a matrix, for example aligned rows and columns as depicted in FIG. 1. To provide a greater number of air springs, the apertures could be arranged as offset rows, or in a honeycomb configuration. The apertures are dimensioned to accommodate an air spring and support it in an upright position.

Lower section 25 includes one or more layers of support material. As will be understood by those familiar with mattress construction, the lower section is farthest from the user's body and provides a degree of support along with firm texture capable of resisting pressure. Support material means bedding layers that are primarily supportive and secondarily pliable. In the invention, this is achieved by providing a high density foam layer 22. Layer 22 is made of polyurethane foam or memory foam having a density between 35-50 kilograms per cubic meter (kgs/m3).

The outer cover consists of a soft durable layer that holds the various sections and layers in place. The outer cover is shown as two pieces top cover 12 and bottom cover 24 that may be joined together at their rectangular open ends by a zipper. Alternatively, a top panel may be joined to a bottom panels by a side panel that is sewn along the top corners and bottom corners to the top and bottom panels. The top panel is quilted, for example, two cotton or synthetic fabric layers having a synthetic or polyester fill that is quilted to hold the fill in place. The outer cover may be fashioned as a rectangular enclosure with an open seam or zipper to place the various sections or layers inside the enclosure and then be sewn or zipped shut.

Figure 3:
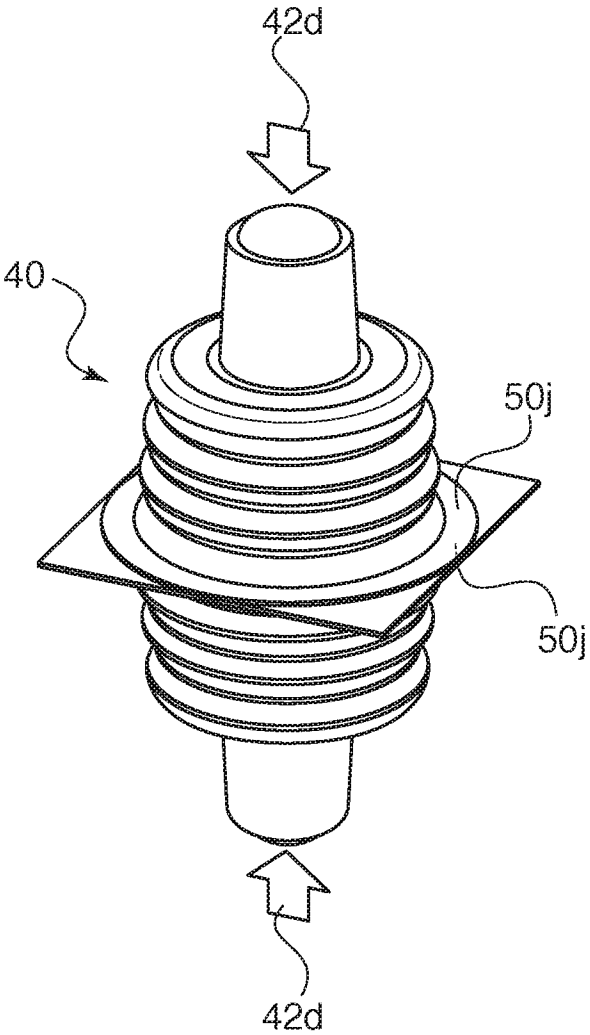
FIG. 3 is a perspective view of the molded cups and form plate with a welded joint to create the sealed inner cavity.
Figure 2:
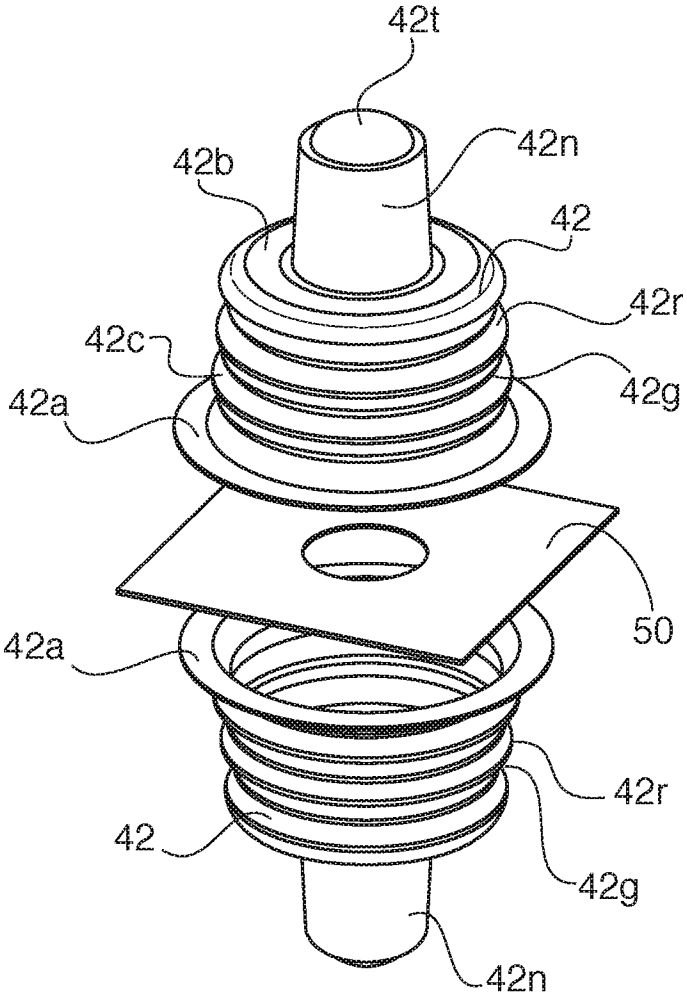
FIG. 2 is an exploded view of molded cups and a form plate of an air spring according to the invention.

FIG. 2 shows a pair of molded cups 42 and form plate 50 that will be coupled with a welded joint to create an air spring 40 with a sealed internal cavity as shown in FIG. 3. Molded cup 42 includes a nipple **42*n* extending from bottom 42*b*, cylindrical side 42*c* and annular lip 42*a*. The end of the nipple terminates in a dome-shaped bulbous tip 42*t*. The cylindrical side includes alternating ribs 42*r* and grooves 42*g***. These constituent members are created as a unitary part, for example by injection molding, to form a complete molded cup. The molded cups are made from polyvinyl chloride (pvc), polyurethane (pu) or synethic rubber. The thickness of the various parts of the cup are varied to provide different functionality in the completed self-inflated air spring. The annular lip has a thickness that allows it to be readily welded to the form plate. The cylindrical side has a thickness to allow bellows-like compression and recovery. The nipple has a thickness to allow it to transition from the outwardly extended position to the inwardly extending, self inflated position. In other words, the nipple has a flexible tubular side wall capable of folding in on itself and then expanding back to the extended side wall.

A form plate 50 is stamped or die cut from a sheet to create a calendared form plate. The form plate can also be extruded to create an extruded form plate. The calendared form plate has a square shape that can efficiently be die cut from the sheet with minimal waste. The calendared form plate also includes a central opening so that air can flow between the upper and lower cups. The form plate provides structural support in the middle of the air spring to maintain its cylindrical shape under pressure. In the first instance, the form plate provides tension in the middle of the air spring to prevent it from bulging outwards upon self inflation. In the second instance, the form plate resists compression to prevent the air spring from collapsing in on itself when subject to uneven or lateral pressure. The form plate is made from the same material as the molded cups, and has a thickness of between 0.2-0.4 mm.

Two oppositely facing cups and one intermediate form plate are aligned so that the form plate's central opening is concentrically located with respect to the cylindrical sides. The annular lips from above and below are joined to the form plate to create a welded joint 50*j* as shown in FIG. 3. The joining process fuses the annular lips to the form plate, both made of the same material, by high frequency welding. The welded joint 50*t* seals the annular lips all about their peripheries to encapsulate a sealed internal cavity. The sealed internal cavity is composed of the space inside two cups, and more particularly the space within the two cylindrical sides and the two nipples.

Figure 4:
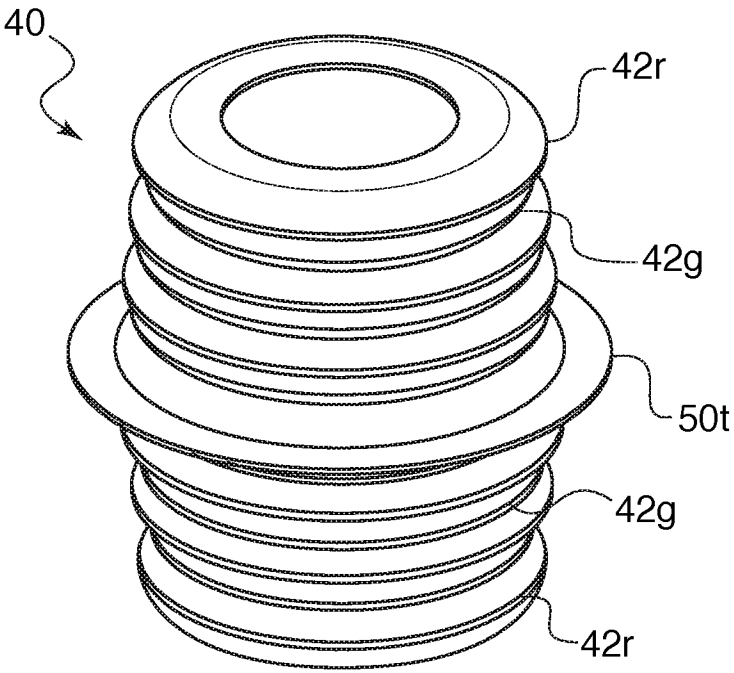
FIG. 4 is a perspective view of the air spring with the form plate trimmed back to the annular lips.

The protruding form plate material and corners shown in FIG. 3 are trimmed back to the annular lips as shown in FIG. 4. The two nipples are depressed from their outwardly extended position as shown in FIG. 3 by pressing both toward each other in inward direction 42*d*. The nipples are now inverted to a location concentrically within cylindrical sides as shown in FIG. 4. The volume within the sealed air spring has been reduced resulting in a self inflated air spring.

By way of example, consider that each cup has a volume of five units plus a nipple volume of 1 unit. The sealed air spring of FIG. 3 would therefore have an internal volume equal to two cups and two nipples, or 5+5+1+1=12 units. When the nipples are depressed, the original nipple volume is eliminated and one unit of cup volume is displaced. The resulting internal volume upon depressing two nipples is: 12−1−1−1−1=8 units. The original volume of 12 units has been decreased by 4 units, or 33%. In practice, air springs have been designed for an internal pressure increase of approximately between 0.02-0.06 psi above the atmospheric pressure present when the cups are welded together.

Figure 5:
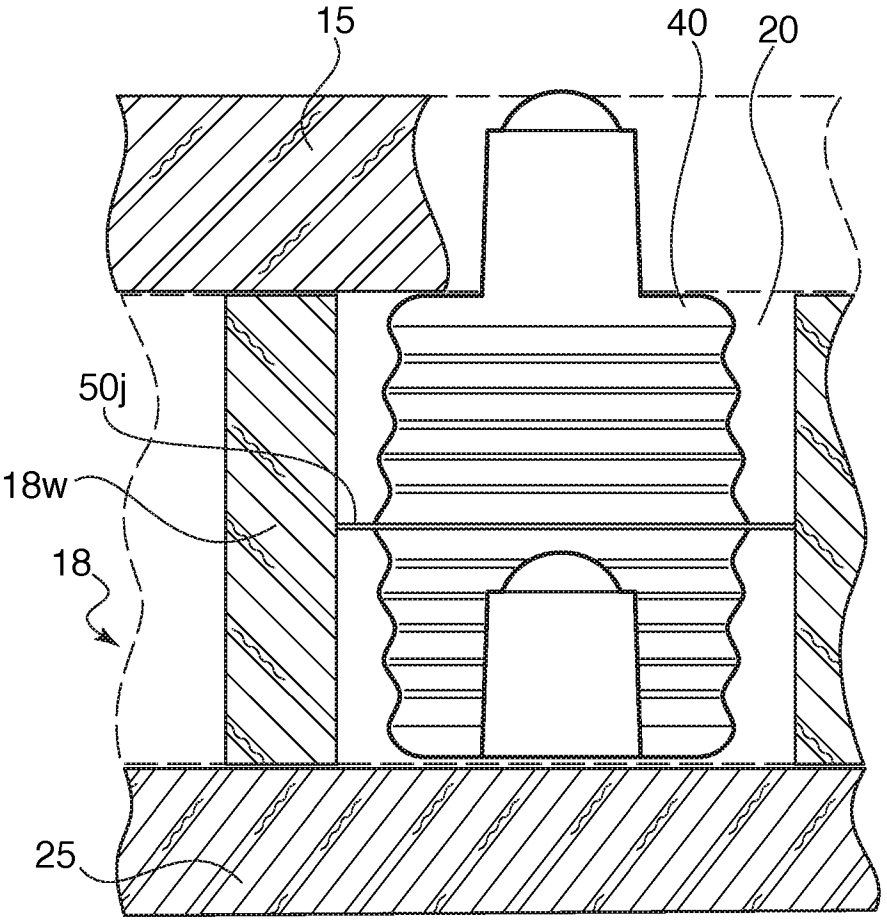
FIG. 5 is a cross-sectional view taken along the line V-V of FIG. 1 of the air spring partially self inflated and located within an aperture of the middle layer.

In a further example, the cups can be welded together with one nipple extended and one depressed (i.e. the configuration shown in FIG. 5). The cup (5 units) with the extended nipple (1 unit) has the same 6 unit volume as the above example. The cup with the depressed nipple has a 4 unit volume. Accordingly the original volume of the sealed air spring would be 6+4=10 units. When the one extending nipple is depressed, its corresponding cup is reduced by 2 units. The resulting internal volume is: 10−1−1=8 units. The original volume of 10 units has been decreased by 2 units, or 20%. Therefore, one mold can produce cups which be used to create two different air spring stiffnesses, depending on whether both cups or only one cup is extended during creation of the welded joint 50*t*. In practice, air springs have been designed to produce an air pressure increase of between 15-30% depending on the size of the nipple, and whether 0 or 1 nipple is depressed before welding. Of course, the cup size and dimension along with the nipple size and dimension can be adjusted to provide a greater or lesser degree of internal volume reduction.

The "spring" portion of air spring 40 consists of annular ribs 42*r* and alternating annular grooves 42*g* along the cylindrical side. The ribs extend circumferentially outwardly in a V shape. The grooves extend inwardly in an inverted V shape. Taken together, the ribs and grooves form interlocked Vs resulting in a multiple W or wave configuration along the side wall of the molded cup. In the embodiment shown, each cup includes three annular ribs and three annular grooves, with an additional rib being formed at the open ends of the cup by the joining of the two annular lips. Of course, the number, height and diameter of the ribs and grooves may be adjusted to provide an air spring with different "spring" properties.

FIG. 5 is a cross-sectional view taken along the line V-V from FIG. 1. A section of vertical wall 18*w* of middle layer 18 is shown with one air spring receiving aperture 20 to its left and another air spring receiving aperture 20 to its right. The figures show the apertures as through-apertures, i.e. extending entirely through the middle layer 18. The diameter of aperture 20 is approximately the same as the diameter of welded joint 50*j*. Since middle layer 18 is made from foam, the sidewall 18*w* of the aperture is resilient. The diameter of welded joint 50*j* may be slightly larger than the diameter of the aperture, so that the welded joint is frictionally engaged to the sidewall to hold the air spring in its upright position. The lower nipple is depressed and bottom of the air spring along with the bottom of middle layer 18 rests upon lower section 25. During final assembly, the upper nipple will be depressed and the upper section 15 will rest atop of the air spring along with the top of middle layer 18. This sandwich construction will create a fitted envelope for the air spring in which the upper section 15 and the lower section 25 will keep the nipples in their depressed positions. In addition, the envelope has free space between the ribs/grooves and the sidewall of the aperture. The ribs and grooves function like a bellows, and allow the air spring to compress and expand in a vertical direction. The free space in the envelope of the aperture allows the ribs to flex outwardly during compression without interference from the side wall 18*w*. The upper section, middle section and lower section are held in place by the outer cover.

The entire assembly of the air mattress can be summarized in the following steps. Injection molding with pvc, pu or synthetic rubber in one show to form a unitary molded cup having an annular lip, cylindrical sides with alternating ribs and groove and a bottom with an outwardly extending nipple terminating in a bulbous tip. Extruding a 0.2-0.4 mm sheet from the same material as the cup and then calendaring the sheet to produce square form plates having a central opening. Arranging two molded cups in opposite directions with their annular lips aligned and in contact with the form plate. Directing high frequency energy at the annular lips to create a welded seal air spring with one or both nipples depressed inwardly. Providing multiple pu or memory foam layers in densities varying from 10-50 kgs/m3. Forming a series of apertures in one of the foam layers arranged in rows/columns, or offset rows, in a matrix, or in a honeycomb layout. Placing air springs with both nipples depressed inwardly into all of the apertures. Stacking all of the foam layers and securing them in place within an outer cover to form an air mattress.

Having described preferred embodiments for a multilayer air mattress which are intended to be illustrative and not limiting), it is noted that modifications and variations can be made by persons skilled in the art in light of the above teachings. For example, the number of layers or the thickness of the different layers can be varied to provide mattresses with different support or comfort properties. The dimensions of the cylindrical side and nipple can be adjusted to provide air springs with different pressurizations. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A multi-layer air mattress comprising:

an upper section having one or more layers of comfort material;

a middle layer having a height and a plurality of air spring retaining apertures arranged in a matrix;

a lower section having one or more layers of support material; and an air spring completely disposed in each air spring retaining aperture, wherein said air spring includes a sealed internal cavity in communication with two opposing invertible nipples that are pressed into the internal cavity to reduce the cavity volume and self inflate the air spring, wherein said self inflated air springs are independent from each other and have the same height as said middle layer.

2. The mattress of claim 1, wherein said nipples have (i) an outwardly extending position in which the air spring is at an initial atmospheric pressure and (ii) an inwardly extending position in which the air spring is at an elevated pressure above the initial pressure without requiring external inflation or a compressor.

3. The mattress of claim 2, wherein said air spring comprises two molded cups, wherein each cup includes a bottom, a cylindrical body and an annular lip, wherein said annular lips of said two molded cups are hermetically sealed to each other around their entire periphery to form the sealed internal cavity.

4. The mattress of claim 2, wherein said air spring comprises two molded cups and a form plate, wherein each cup includes a bottom, a cylindrical body and an annular lip, wherein said annular lips of said two molded cups are hermetically sealed to opposing sides of the form plate around their entire periphery to create the sealed internal cavity.

5. The mattress of claim 4, wherein said nipple is disposed at the bottom of said molded cup, and wherein said molded cup is made from a material selected from the group consisting of polyvinyl chloride, polyurethane and synthetic rubber.

6. The mattress of claim 5, wherein said cylindrical side includes alternating annular ribs and annular grooves that form bellows-like folds to compress and expand under changing pressure.

7. The mattress of claim 6, wherein said nipple in the inwardly extending position is disposed concentrically within the annular ribs and grooves.

8. The mattress of claim 7, wherein said nipple includes a flexible tubular wall that folds in on itself when the nipple is transitioning between its outwardly extending position and its inwardly extending position.

9. The mattress of claim 8, wherein said nipple includes a bulbous tip that is domed away from said form plate when the nipple is in the outwardly extending position and is domed toward said form plate when the nipple is in the inwardly extended position.

10. The mattress of claim 5, wherein said form plate comprises a calendared form plate with an opening formed therein, and wherein two annular lips are welded to opposing sides of the form plate to create a welded joint, and wherein under pressure air flows from one welded cup to the other welded cup through the opening while the calendared form plate maintains the annular lips at their circular configuration to resist expansion and collapse of the cylindrical bodies.

11. The mattress of claim 10, wherein said calendared form plate is made from the same material as said molded cup has a thickness of 0.2-0.4 mm thick, and is trimmed to the circular dimensions of the welded annular lips.

12. The mattress of claim 11, wherein the air spring retaining apertures have a diameter approximately the same as the trimmed, calendared form plate and the welded annular lips.

13. The mattress of claim 12, wherein said middle layer is made from a material selected from the group consisting of polyurethane foam and memory foam.

14. The mattress of claim 13, wherein said upper section includes a medium density foam layer made from a material selected from the group consisting of polyurethane foam and memory foam and having a density between 20-35 kgs/m3 set atop a low density foam layer made from a material selected from the group consisting of polyurethane foam and memory foam and having a density between 10-20 kgs/m3; and wherein said lower section includes a high density foam layer made from a material selected from the group consisting of polyurethane foam and memory foam and having a density between 35-50 kgs/m3.

15. The mattress of claim 11, wherein the retaining aperture diameter is greater than the diameter of said annular ribs and grooves so that the annular ribs and grooves can compress and expand like a bellows without interfering contact with the middle layer.

16. The mattress of claim 10, wherein each air spring includes two nipples, and both nipples are in the outwardly extending position upon creation of the welded joint to set the initial pressure, wherein both nipples are depressed into the inwardly extending position to establish the elevated pressure.

17. The mattress of claim 4, wherein said middle layer has a height equal to the height of two molded cups when both nipples are depressed, whereby said middle layer and said internally disposed self-inflated air springs are sandwiched between said upper and lower sections.

18. The mattress of claim 16, wherein depressing both nipples results in an elevated pressure that is between 0.02-0.06 psi greater than the initial pressure.

* * * * *